US005117095A

United States Patent [19]

Corbett

[11] Patent Number: 5,117,095

[45] Date of Patent: May 26, 1992

[54] PLASTIC ACTUATOR FOR POSTAGE MACHINE

[75] Inventor: Mark S. Corbett, Hamden, Conn.

[73] Assignee: Pitney Bowes Inc., Stamford, Conn.

[21] Appl. No.: 632,824

[22] Filed: Dec. 24, 1990

[51] Int. Cl.[5] ..... G07G 1/10

[52] U.S. Cl. ..... 235/101

[58] Field of Search ..... 235/101; 101/91, 61

[56] References Cited

U.S. PATENT DOCUMENTS 4,339,196 7/1982 Beck et al. ..... 355/300

4,441,420 4/1984 Buan et al. ..... 101/69

4,635,204 1/1987 Jones et al. ..... 364/464

*Primary Examiner*—L. T. Hix

*Assistant Examiner*—Eddie C. Lee

*Attorney, Agent, or Firm*—Charles G. Parks, Jr.; David E. Pitchenik; Melvin J. Scolnick

[57] ABSTRACT

A plastic actuator for a postage meter is provided with a resilient extension having a plurality of detents adapted to engage a detent post at fixed positions of the actuator. The extension is not stressed at these fixed positions, and is not subject to any stresses greater than the yield point during rotation.

8 Claims, 4 Drawing Sheets

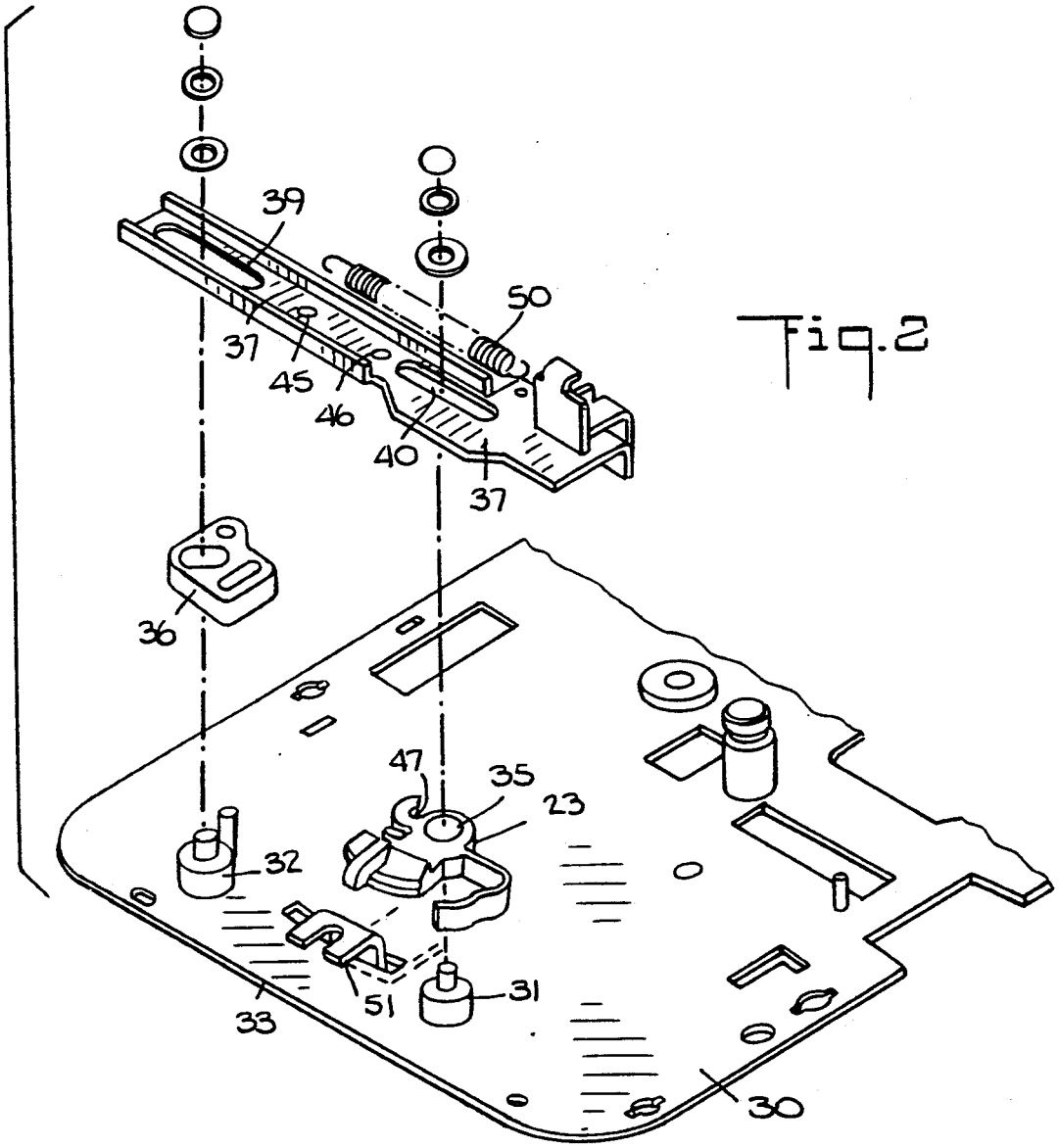
Fig. 2
Fig. 3
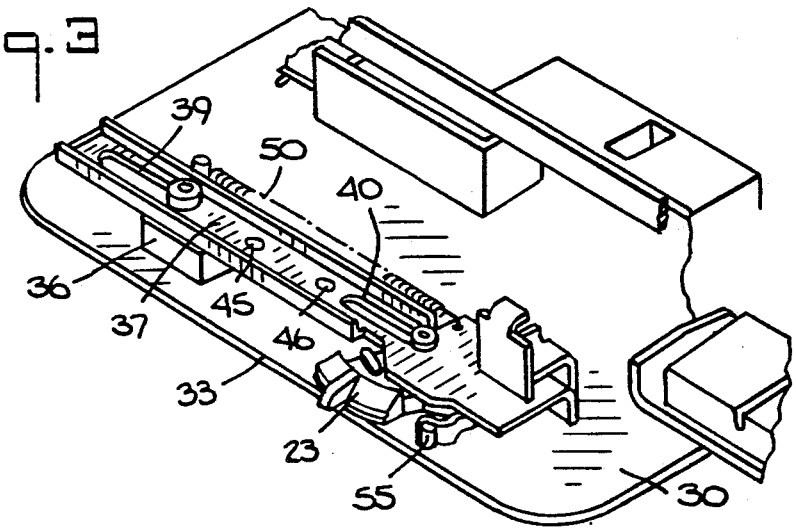

PLASTIC ACTUATOR FOR POSTAGE MACHINE

This invention relates to postage meters, and is more in particular directed to the provision of an improved plastic actuator enabling an operator to select MANUAL or AUTOMATIC modes for the ejection of mail pieces from the machine.

BACKGROUND OF THE INVENTION

In some postage machines, such as the type 6900 postage meter manufactured by Pitney Bowes Inc. of Stamford Conn., a plastic actuator has been provided on the machine to enable an operator to select whether mail pieces are ejected automatically from the machine after postage is printed thereon (AUTO), or whether this automatic ejection is disabled (MAN).

FIGS. 9 and 10 illustrate a known actuator of a plastic material. The actuator has a mounting hub 100, and a slot 101 is provided adjacent the hub to receive a control part of the postage meter, whereby rotation of the actuator causes the desired movement of the control part. The actuator also has base portion 103 with a manual knob 104 extending therefrom to permit rotation of the knob by a user. A fork shaped portion 105 is adapted to engage a fixed post in the postage meter, and this portion 105 is resiliently connected to the base portion 103 by an arcuate section 106.

As is known, plastic material creeps under stress, and can cause parts made therefrom to lose there functionality. In the arrangement of FIGS. 9 and 10, there are two positions of the actuator, i.e. manual and auto. When in the manual and auto positions, the actuator, especially the portion 106 thereof, is stressed and will lose resilience and break down. When this happens, the actuator is prevented from locking in the AUTO eject mode, causing the setting to float toward the MANUAL eject mode.

SUMMARY OF THE INVENTION

It is therefore an object of the invention to provide an actuator for a postage meter that overcomes the above disadvantage of the known actuator.

Briefly stated, in accordance with the invention, the actuator comprises a hub and has a control slot for controlling the manual and automatic ejection functions of the postage meter. The hub may be connected to a base from which a manual control knob or the like depends. A detent post is mounted to the postage meter at a position spaced from the hub, and the actuator has a resilient extension from the base having a plurality of detents that engage the post at different angular displacements of the actuator. The resilient portion is dimensioned and shaped to be subject to no stresses when the detents are aligned with the post, and to be subject to no greater stresses than the yield point upon rotation of the actuator.

BRIEF DESCRIPTION OF THE DRAWING

In order that the invention may be more clearly understood, it will now be disclosed in greater detail with reference to the accompanying drawing, wherein:

FIG. 2 is an exploded perspective view of a portion of a postage meter incorporating the plastic actuator;

FIG. 3 is an assembled perspective view corresponding to FIG. 2;

DETAILED DISCLOSURE OF THE INVENTION

Figure 1:
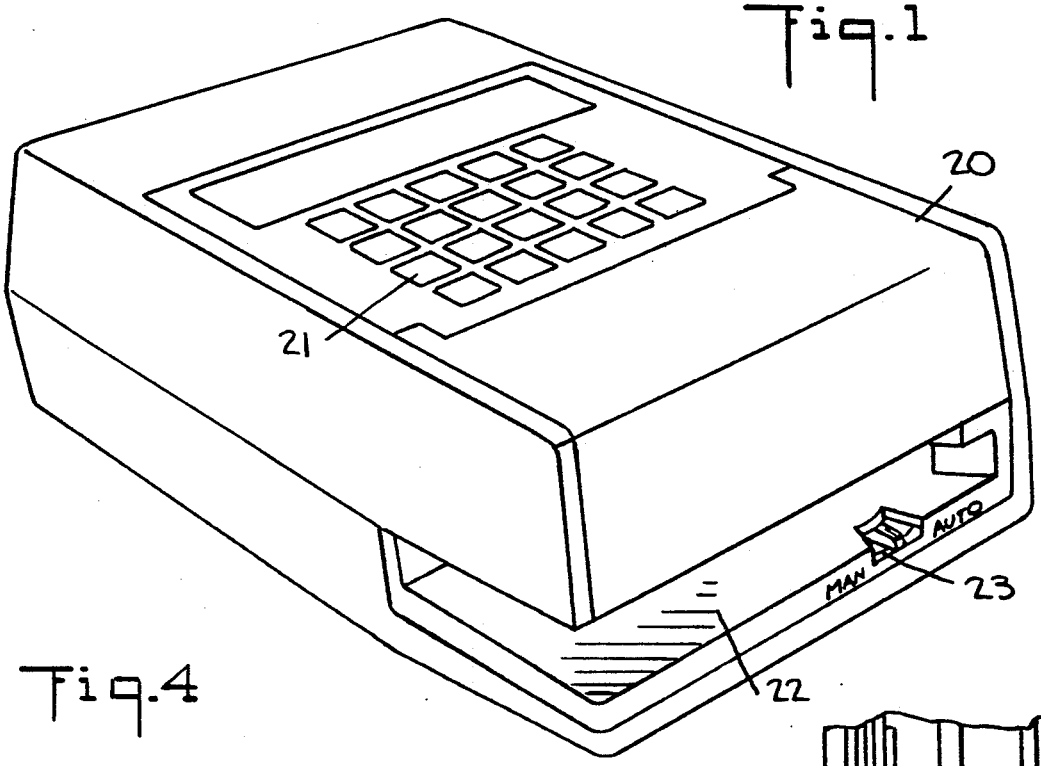
FIG. 1 is a perspective view of a postage meter that may incorporate the plastic actuator of the invention.

FIG. 1 illustrates a postage meter of the type with which the present invention is concerned. The meter has a housing 20, a keyboard 21 for entering the value of postage to be printed, and a circumferentially extending slot 22 for receiving mail pieces on which indicia is to be printed. A plastic control or actuator 23 is provided in order to enable an operator to select either manual or automatic ejection of the mail pieces from the slot.

Figure 4:
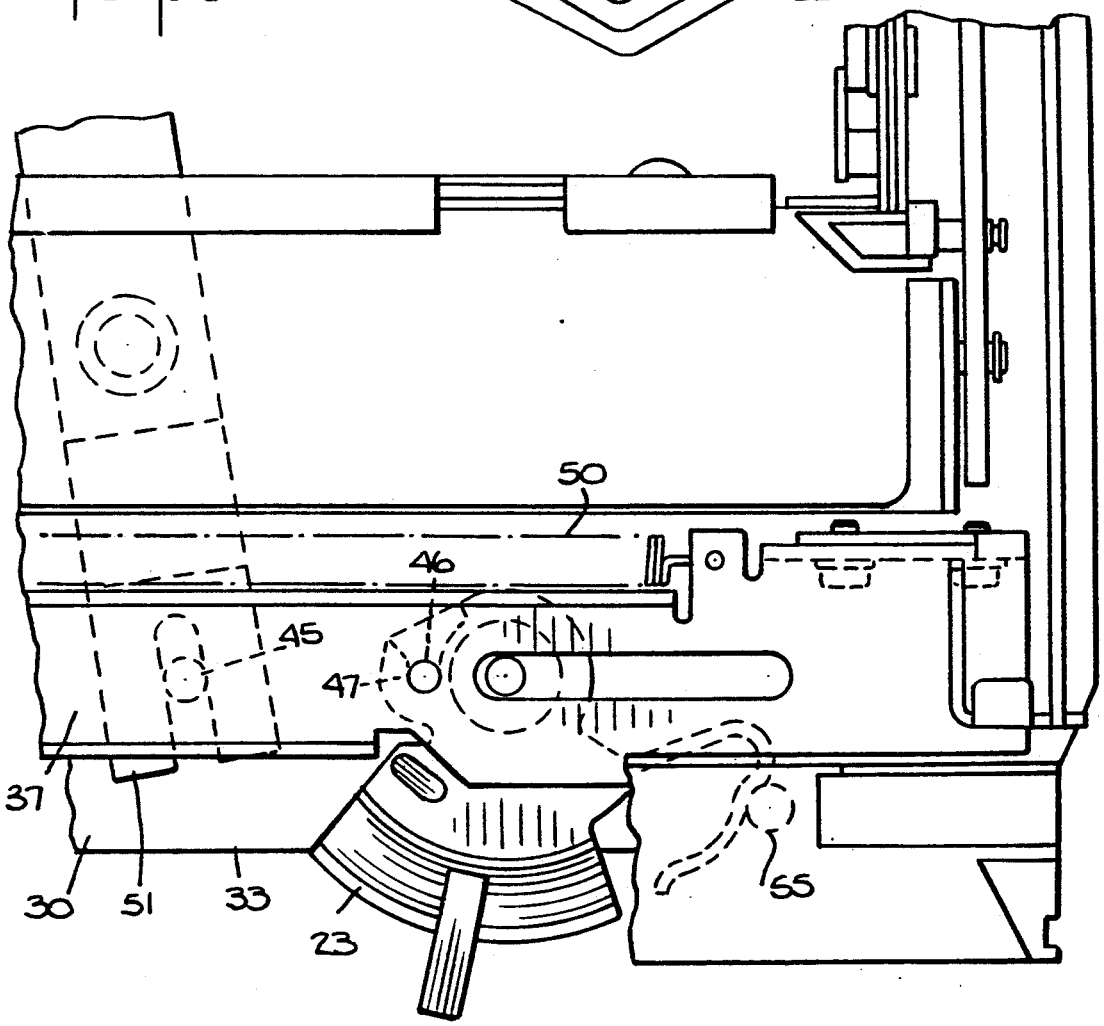
FIG. 4 is an enlarged top view corresponding to FIG. 3.
Figure 5:
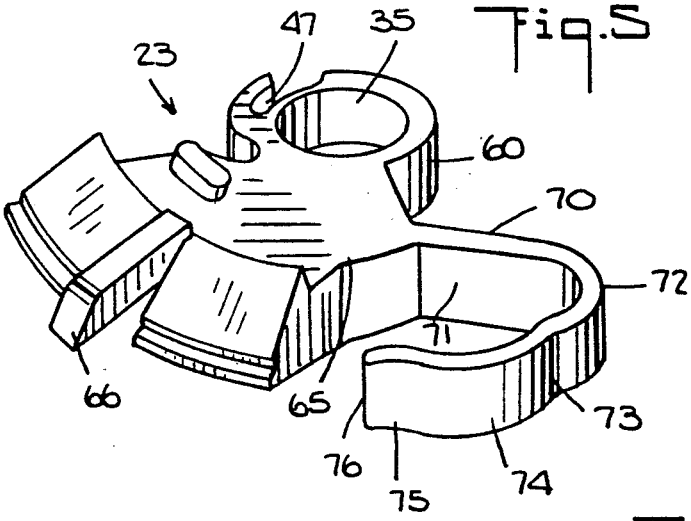
FIG. 5 is a perspective view of an actuator in accordance with the invention.

FIGS. 2–4 illustrate the portions of the internal structure of the postage machine with which the actuator is associated. Thus, the machine includes a base or chassis 30. A pair of spaced apart support posts 31, 32 extend upwardly near the front 34 of the chassis, the support posts having enlarged bases. The pivot aperture 3 of the actuator 23 is received by the enlarged base of the support post 31, and a support block 36 is positioned on the enlarged base of the port 32. A control slider 37 has a pair of slots 39, 40 that slidable receive the upper portions of the posts 32, 31 respectively, and suitable hardware such as washers and fasteners (unnumbered) are provided on the upper ends of the support posts to permit the control slider to be slid for a limited displacement on the support posts.

The control slider 37 has a pair of control pins 45, 46 extending downwardly therefrom, between the support posts 31, 32. The actuator 23 has a control slot 47 at one region of its periphery adapted, to coact with the control pin 46 to urge the control slider 37 in a direction toward the right hand side of the page, and a spring 50 is connected between the chassis 30 and the control slider 37 to urge the control slider 37 toward the left hand side of the page. The control pin 45 is positioned to engage a slot in the end of a control lever 51 pivoted to the chassis, so that rotation of the actuator 23 in one direction controls the movement of the lever 51 in one direction, acting via the slider 37, and rotation of the actuator 23 in the opposite direction effects the movement of the lever 51 in the opposite direction by the spring 50, acting via the slider 37.

In addition, a detent receiving post 55 (FIG. 3) mounted to extend upwardly to engage a portion of the actuator, as will be discussed later in greater detail.

The control lever 51 is connected by suitable means to control the manual and automatic ejection modes of the postage meter. Since such control is a part of the prior art, and is not of concern to the concept of the present invention, there is no need to describe such mechanism herein.

Figure 6:
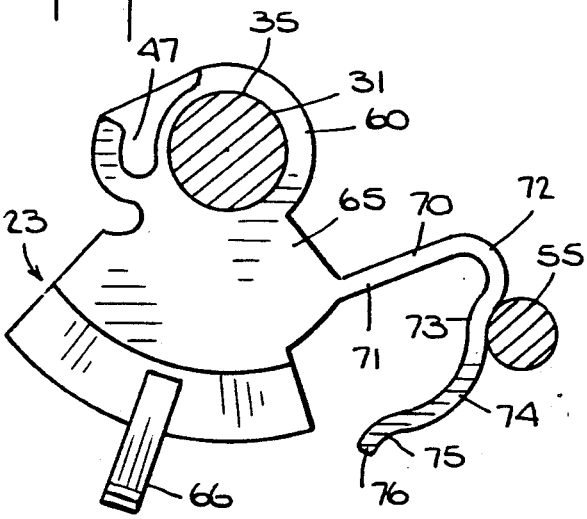
FIG. 6 is a top view of the actuator in one operative position.
Figure 7:
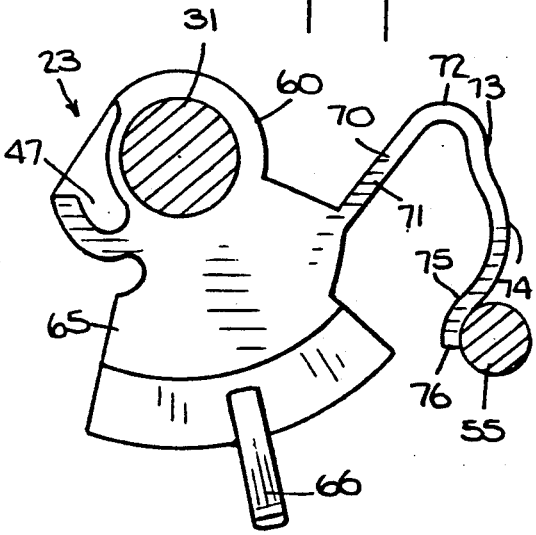
FIG. 7, is a top view of the actuator in another operative position.
Figure 8:
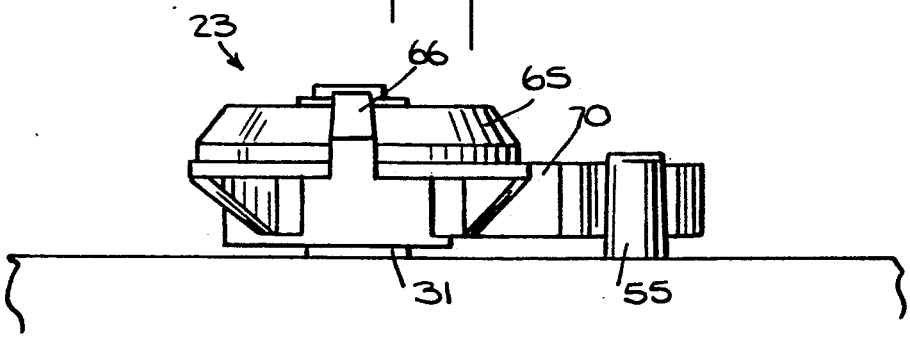
FIG. 8 is a side view of the actuator.
Figure 9:
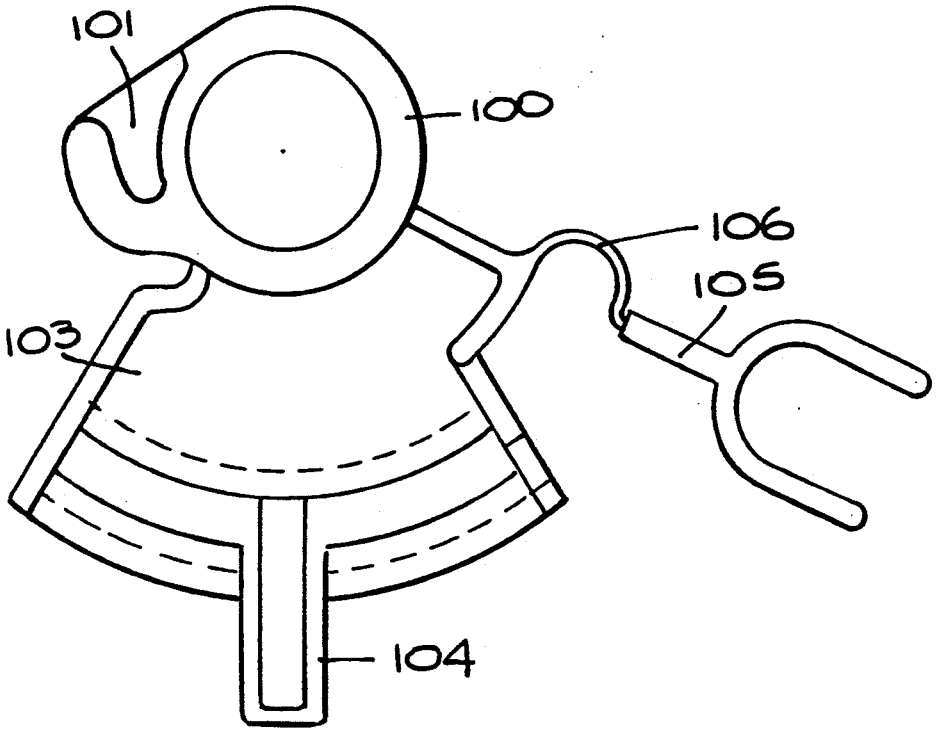
Fig. 9 PRIOR ART
FIG. 9 is a top view of a prior art actuator.
Figure 10:
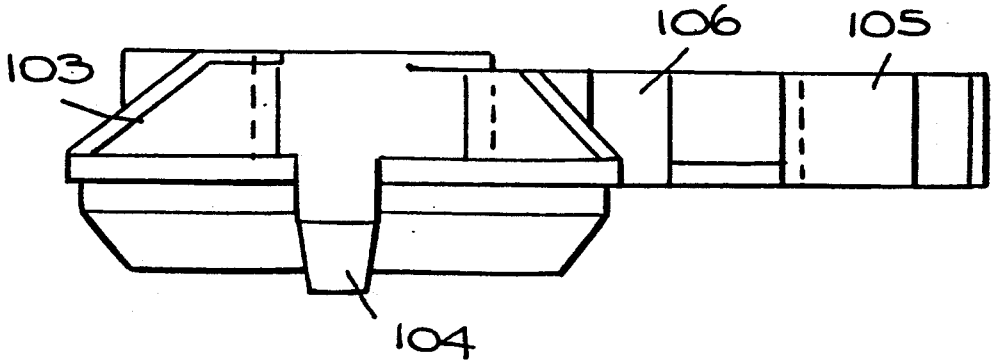
Fig. 10 PRIOR ART
FIG. 10 is a side view of the actuator of FIG. 9.

The actuator 23 of the invention, as illustrated in greater detail in FIGS. 5–8, is of a plastic material such as an acetal with a Young's modulus of 410,000 psi. It has a hub 60 surrounding the mounting aperture 35, with the control slot 47 being formed at one side of the hub 60. The control slot 47 is shaped to receive the control pin 46 (FIGS. 2–4) of the postage meter. The hub 60 is affixed to a base portion 65, with a manual control knob 66 being formed on the base portion 65. In order to enable the manual control 66 knob to be releasably held at the MAN and AUTO positions thereof, a resilient extension 70 depends from the base portion 65. This resilient extension 70 is of substantially constant height and width throughout its extent. It has a first portion 71 adjacent the base portion 65 that is generally straight and terminating in a first arcuate portion 72 that is substantially semicircular. The first arcuate portion 72 terminates in a first detent region 73. The extension then continues in an second arcuate portion 74 having its radius of curvature on the same side of the extension 70 as the semicircular portion 72, this second arcuate portion 74 terminating in the second detent region 75. The detent regions 73, 75 are positioned to engage the detent post 55 at the two set positions of the actuator, 23 as illustrated in FIGS. 6 and 7. The resilient extension 70 may terminate in a short arcuate end portion 76 to prevent slipping off the end of the resilient extension 70 from the detent post 55. The centers of curvature of the first and second detent regions 73 and 75 are both on the side of the extension 70 facing away from the base portion 65. The centers of curvature of the first and second arcuate portions 72 and 74 are both on the side of the extension 70 toward the base portion 65.

In one embodiment of the invention, the actuator 23 had a height of 0.3 inches, an aperture 35 diameter of about 0.5 inches, and a hub wall thickness of 0.1 inches. The outer radius of the actuator at the knob was 1.42 inches, and the thickness of the extension 70 was 0.3 inches. The angular displacement between the two detents 73, 75 was about 24 degrees. The detents are dimensioned so that no stress is applied to the actuator when the detents engage the posts 55, and the maximum stress applied thereto during rotation is below the yield point.

The actuator 23 in accordance with the invention has been found to allow repeated setting changes from Manual to Auto mode without causing a decrease in the flexural modulus of the extension 70 of the actuator. It is designed to be without stress in either position. The stress experienced by the actuator is only present when moving between auto and manual eject positions. The stress is also kept below the yield point for the plastic, thereby eliminating permanent deformation.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. An improved postage meter of the type having an automatic/manual operable ejection acturator pivotally mounted to a base, the actuator having a mounting hub with a base portion extending therefrom, a control slot for co-acting with a control pin which is received by a control lever pivoted to a chassis and for positioning the postage meter in a first and second position in response to the pivotal motion of the actuator, and a detent means for interacting with a coupling means mounted to said base to maintain the hub in the selected first or second position, wherein the improvement comprises said detent means having a continuous resilient extension having a first end fixably mounted to said base portion, and a first and second detent portion formed along a continuous engaging surface; said first and second detent portions are recessed such that in a radial distance from an epicenter of the hub flexing stress on the continuous resilient extension when engaged with the coupling means in said selected first or second position is zero.

2. The postage meter of claim 1 wherein said continuous resilient extension has a substantially constant thickness and height throughout.

3. The postage meter of claim 1 wherein said continuous resilient extension having a first arcuate portion between said base portion and said first detent portion and a second arcuate portion between said first detent portion and said second detent portion, said arcuate portions having centers of curvature on a side opposite the continuous engaging surface and toward said base portion.

4. The postage meter of claim 1 wherein said actuator is of an acetal material.

5. The postage meter of claim 1 wherein said continuous resilient extension further comprises a straight portion between said base portion and said first arcuate portion.

6. The postage meter of claim 3 wherein said continuous resilient extension further comprises a straight portion between said base portion and said first arcuate portion.

7. The postage meter of claim 1 wherein said coupling means comprises a post spaced from said hub.

8. The postage meter of claim 3 wherein said coupling means comprises a post spaced from said hub.

* * * * *